US005287243A

United States Patent [19]

Hu

[11] Patent Number: 5,287,243

[45] Date of Patent: Feb. 15, 1994

[54] CIRCUIT DEVICE FOR ELECTROMAGNETIC SWITCH

[75] Inventor: Tien-Cheng Hu, Hsinchu, Taiwan

[73] Assignee: Industrial Technology Research Institute, Hsinchu, Taiwan

[21] Appl. No.: 674,876

[22] Filed: Mar. 25, 1991

[51] Int. Cl.[5] ..... H01H 47/00

[52] U.S. Cl. ..... 361/152; 361/187; 361/205

[58] Field of Search ..... 361/152-154, 361/155, 160, 187, 194, 205

[56] References Cited

U.S. PATENT DOCUMENTS 4,452,210 6/1984 Sasayama et al. ..... 123/490
4,650,052 3/1987 Okada ..... 361/154
4,878,147 10/1989 Oyama et al. ..... 361/154
4,925,156 5/1990 Stoll et al. ..... 251/129.01

*Primary Examiner*—Howard L. Williams
*Assistant Examiner*—Richard Elms
*Attorney, Agent, or Firm*—W. Wayne Liauh

[57] ABSTRACT

Disclosed is a circuit device enabling an electromagnetic switch to be used with an A.C. power source. And the coil is thereof provided with a more stable electromagnetic field. The circuit device includes a releasing voltage detecting circuit, an engaging voltage detecting circuit, an nonstandard AND gate circuit connected to the detecting circuits, and a coil-holding circuit connected so that when there is an engaging voltage in the circuit device, the electromagnetic switch is energized and the coil is kept in a holding state. When there is a releasing voltage, the switch is de-energized.

4 Claims, 6 Drawing Sheets

CIRCUIT DEVICE FOR ELECTROMAGNETIC SWITCH

BACKGROUND OF THE INVENTION

The present invention relates to a switch, and more particularly to an electromagnetic switch.

The electromagnetic switch plays an important role in the modern industrial power supply control and is extensively used in various factories, power panels in the stock room or kinds of ships, elevators, escalators, winches, conveying belts, power switches of working machines or machinery, large equipments, or panels of generating or transforming plants. The working principle of the electromagnetic switch is to mutually contact or release contactors thereon by building a magnetic field around the coil, thereof, to thus energize or de-energize the switch. The current flow depends on the DC type and the AC type in which the former provides a stable power supply but is unsuitable for industrial distribution. The latter can provide a large electrical power, but the contactors thereof have an unstable contact. In detail, since the DC type has a DC working current, the built magnetic field is stable as schematically shown in FIG. 1. Since the industry generally requires an AC power source and, for controlling a relatively small DC power source of 12 V, 24 V or 48 V, the DC electromagnetic switch is not suitable for large power panels in various industries. The AC electromagnetic switch, however, suffers from the following disadvantages:

1) Since the coil of the AC electromagnetic switch has an AC power source normally of 110 V or 220 V (totally amounting to about 90% out of all power sources), the exciting field resulted by the coil will have an alternating magnetic attraction following the alternating change of the AC voltage of the power source. In order to smooth the strength of the alternatingly changing magnetic field, the magnetic core 1 made of silicon steel in the AC electromagnetic switch as shown in FIG. 2 incorporates therewith short-circuited copper rings 4, which attempt to balance and stabilize lines 2 of magnetization. The magnetic attraction is thus produced, however, not so stable as that produced by the magnetic field of a DC electromagnetic switch.

2) Incorporating copper rings 4 to magnetic core 1 will increase the copper loss in the switch. The copper loss transforms into the heat not only represents an energy loss but also reduces the life period of the switch.

3) As shown in FIG. 3, when the coil 3 is flowing therethrough a current and the magnetic attraction overcomes the spring force exerted by the spring 5, the increasing magnetic attraction will eventually engages the electromagnetic switch to close contactors 6 thereon. Since the clearance between the upper and lower magnetic cores 1 is nearly not in existence now, the magnetic reluctance of the magnetic circuit of lines 2 is reduced, so that a small coil maintaining current will be enough to produce a magnetic attraction capable of overcoming the spring force of spring 5 to keep the switch in a holding state. Since the coil of the conventional electromagnetic switch is directly power-supplied by the power source 7 as shown in FIG. 4, the coil cannot be only provided with a maintaining or reduced current after the switch is engaged, which is not energy-effective.

4) The magnetic attraction exerted by coil 3 will increase immediately after coil 3 is switched on. As shown in FIG. 5, when there is no working voltage supplied to coil 3, contactors 6 are in an open state and thus the switch is not in operation. When t=a, coil 3 begins to establish a magnetic field but contactors 6 are still not closed. When t=b, magnetic attraction is approximately equal to the spring force exerted by spring 5 and thus the electromagnetic switch is in a floating state. When t=c, the working voltage is equal to the engaging voltage 8 (Ve), which means that the resulted magnetic attraction is larger than the exerted spring force so that contactors 6 are closed to engage the switch. At the time period between t=b and t=c, contactors 6 have a bouncing contact and sparks therebetween which not only damages contactors 6 but also adversely influences the power-supplied load device.

5) During the time period between t=c and t=d, the working voltage is stable and thus the switch is kept in a holding state. When t=d, the attraction of the magnetic field resulted by coil 3 is approximately equal to the exerted spring force again which means that contactors 6 will have a bouncing contact and sparks therebetween. When t=f, the working voltage is equal to the releasing voltage 9 (Vr) and the magnetic attraction can no more overcome the spring force so that contactors 6 are in an open state again to release the switch. When t=g, the magnetic field built by coil 3 vanishes into the void. Thus, in an operation cycle of the electromagnetic switch, there are two time periods during which contactors 6 will have a bouncing contact and sparks therebetween.

SUMMARY OF THE INVENTION

It is therefore an object of the present invention to provide a driving circuit connected to an AC or DC type electromagnetic switch, which enables the DC type electromagnetic switches to be used with an AC or DC power source.

It is further an object of the present invention to provide a circuit device enabling the coil of the electromagnetic switch to produce a stable magnetic field.

It is additional an object of the present invention to provide a circuit device enabling the coil of an electromagnetic switch to have a prolonged life and to save the energy consumption.

According to the present invention, a circuit device for an electromagnetic switch includes a releasing voltage detecting circuit, an engaging voltage detecting circuit, a nonstandard AND gate circuit connected to the detecting circuits, and a coil-holding circuit connected between the nonstandard AND gate circuit and the coil of the electromagnetic switch in the manner that, when the circuit device receives as an engaging voltage, the electromagnetic switch is energized and the coil is kept in a holding state and, when there is a releasing voltage, the switch is de-energized. Such circuit device enables that the coil of the switch is not directly connected to the power source.

BRIEF DESCRIPTION OF THE DRAWINGS

The present invention may best be understood through the following description with reference to the accompanying drawings, in which.

DETAILED DESCRIPTION OF THE PREFERRED EMBODIMENT

Figure 1:
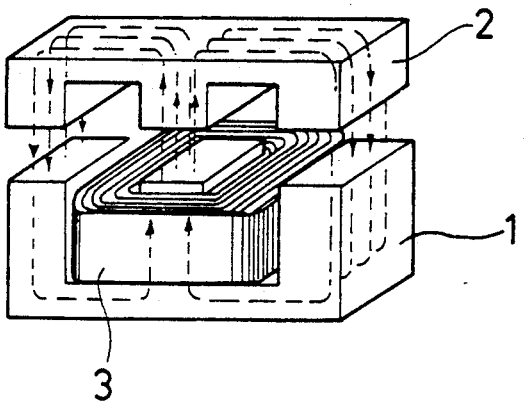
FIG. 1 (PRIOR ART)
FIG. 1 schematically shows a DC electromagnetic switch according to the prior art.
Figure 2:
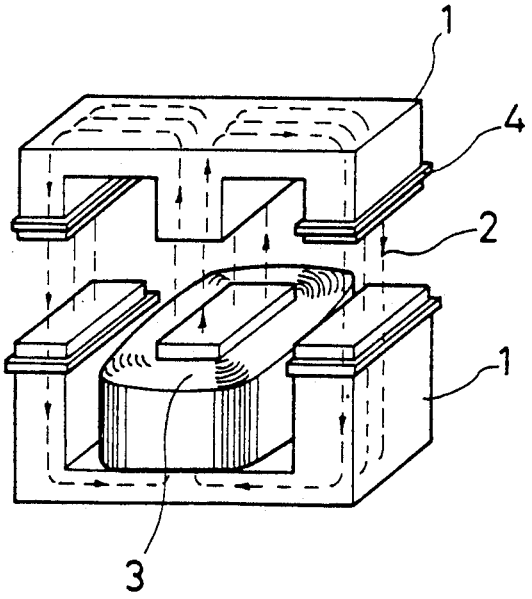
FIG. 2 (PRIOR ART)
FIG. 2 schematically shows a AC electromagnetic switch according to the prior art.
Figure 3:
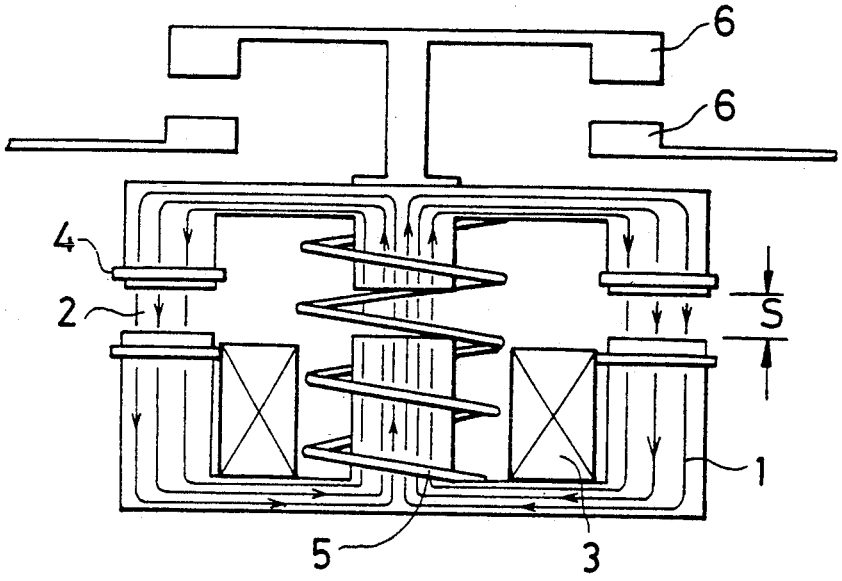
FIG. 3 (PRIOR ART)
FIG. 3 is a structural view showing a switch in FIG. 2.
Figure 4:
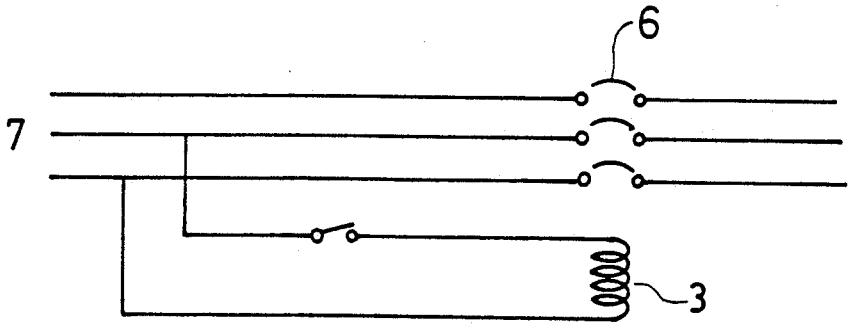
FIG. 4 (PRIOR ART)
FIG. 4 is a circuit diagram showing a switch in FIG. 2.
Figure 5:
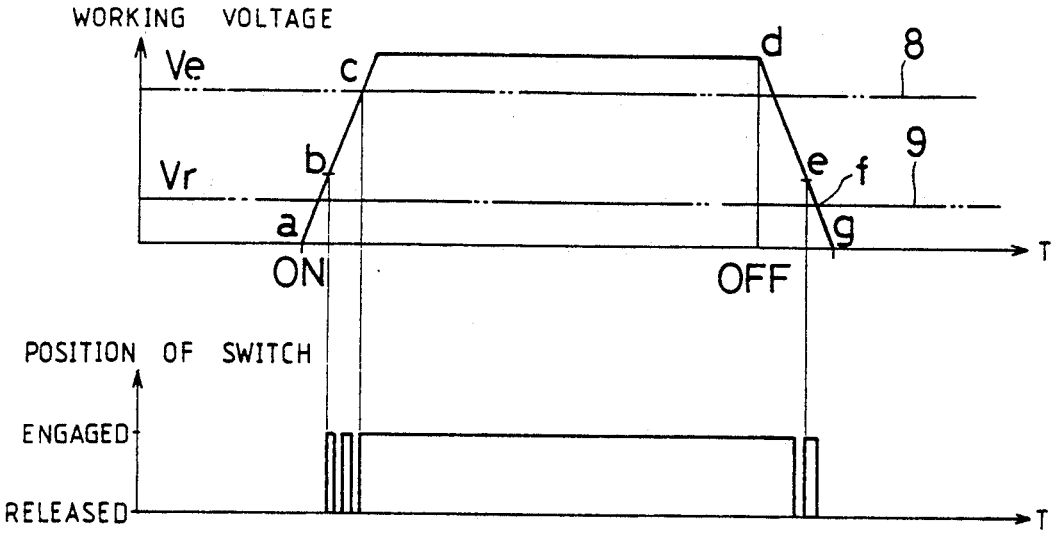
FIG. 5 (PRIOR ART)
FIG. 5 is a wave form characteristic showing an operation of a switch in FIG. 2.
Figure 6:
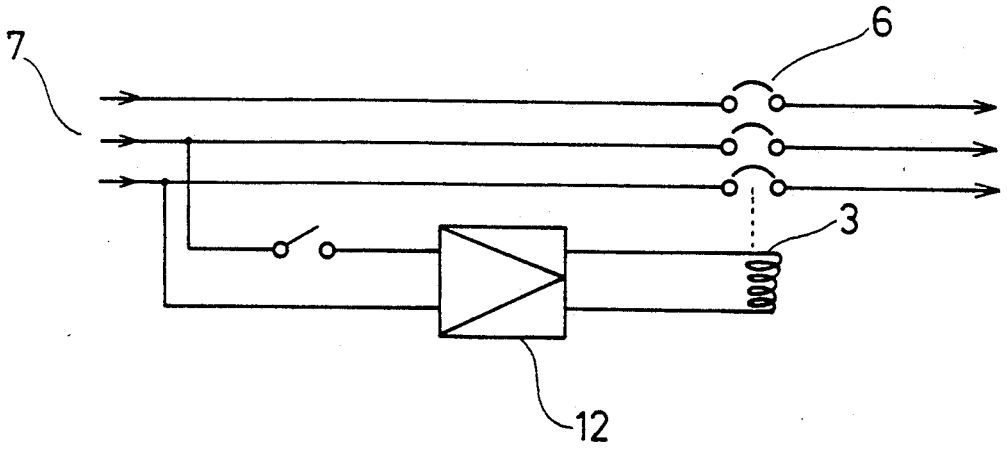
FIG. 6 is a circuit diagram showing an electromagnetic switch incorporating thereto a circuit device according to the present invention.
Figure 7:
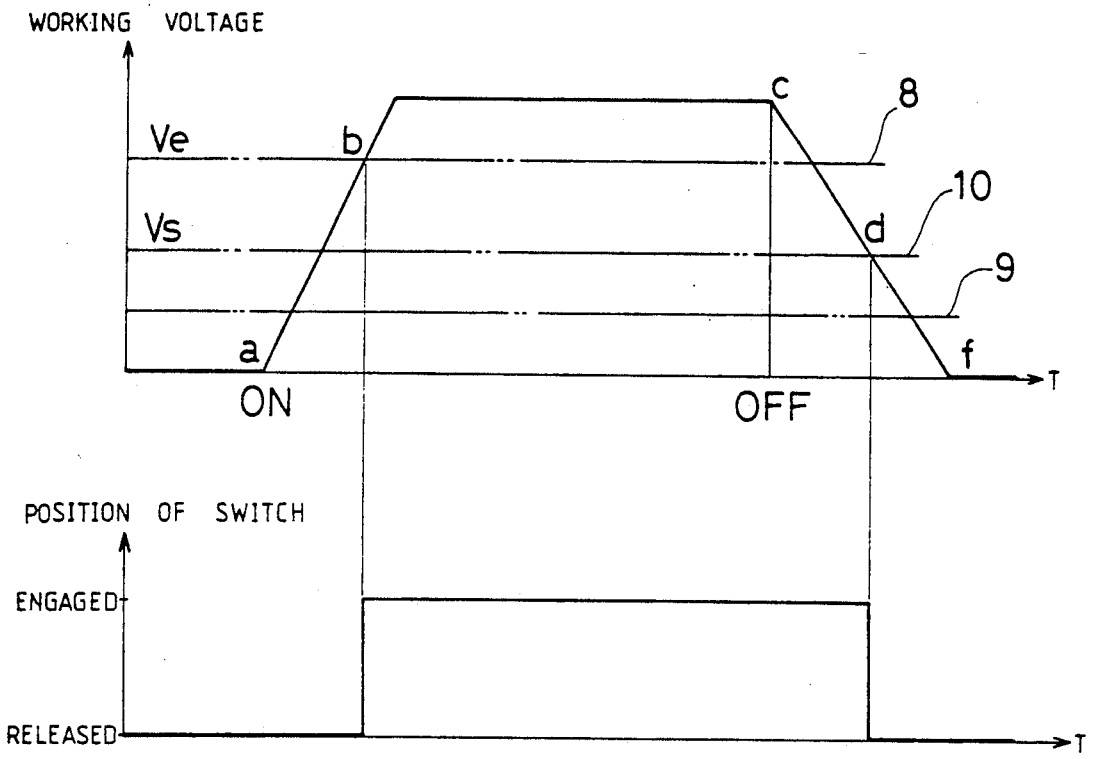
FIG. 7 is a wave form characteristic showing an operation of a switch in FIG. 6.

Referring now to FIGS. 6 and 7, a circuit device 12 according to the present invention is to be connected between the power source 7 and the coil 3 of the electromagnetic switch in order that circuit device 3 will engage the electromagnetic switch only when the working voltage is larger than the engaging voltage 8 (Ve) and will release the switch immediately after the working voltage falls below a preset voltage 10 (Vs), so as to obviate the bouncing contact phenomenon between contactors 6.

Figure 8:
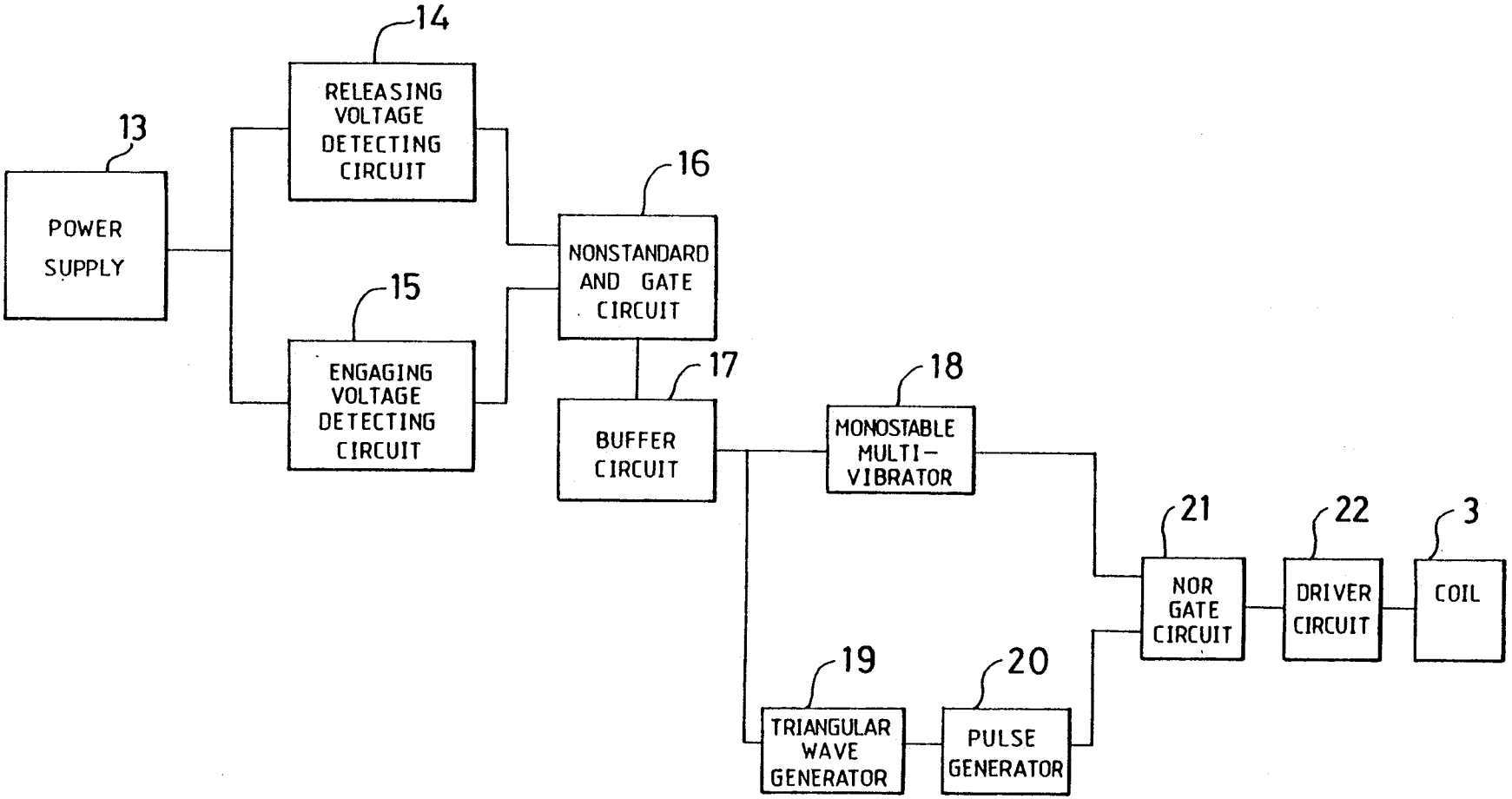
FIG. 8 is a block diagram showing a circuit device in FIG. 6.
Figure 9:
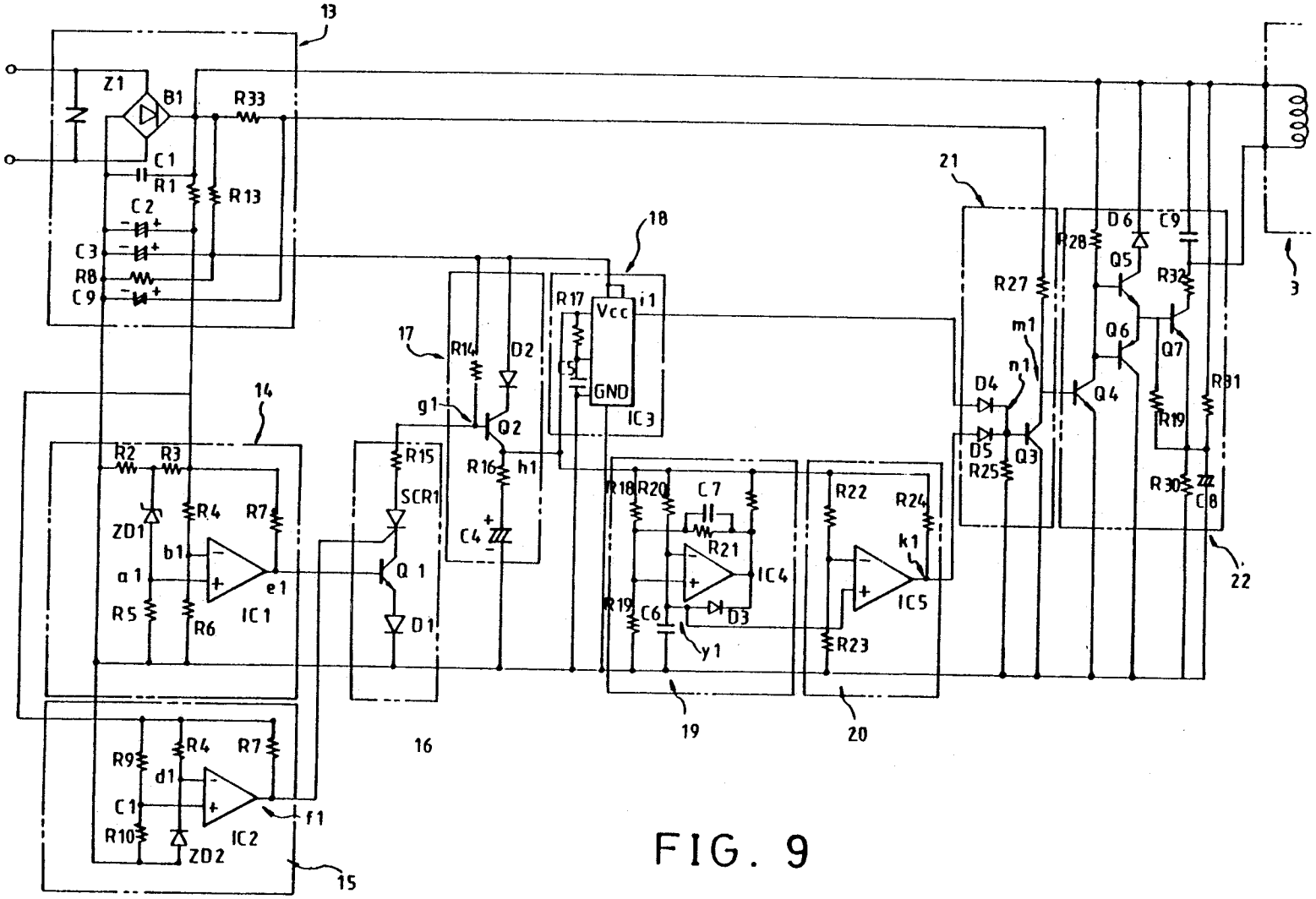
FIG. 9 is a detailed circuit diagram showing a circuit device in FIG. 6.

As shown in FIGS. 8 and 9, circuit device 12, includes a power supply 13, comprising a full-wave bridge-rectifier circuit, a releasing voltage detecting circuit 14 including a first operational amplifier IC1, an engaging voltage detecting circuit 15 including a second operational amplifier IC2, an nonstandard AND gate circuit 16, a buffer circuit 17, a monostable multivibrator 18, a triangular wave generator 19, a pulse generator 20, a NOR gate circuit 21, and a driver circuit 22. When circuit device 12 detects an engaging voltage normally being about 70–75% of the voltage of the input power source 7, the electromagnetic switch is energized and coil 3 is kept in a holding state. When circuit device 12 detects a releasing voltage normally being about 35–40% of the voltage of the power source 7 according to the type of the coil, the coil is de-energized.

The working states of detecting circuit 14 is explained as below: When the voltage of power source 7 proportionally providing a divided voltage through a voltage divider formed by resistors R2 and R3 is smaller than the releasing voltage 9, the divided voltage will be also smaller than the breakdown voltage of the Zener diode ZD1 so that the voltage on the non-inverting input end a1 of IC1 will be smaller than that on the inverting input end b1 and the detecting circuit 14 will have a "LOW" output voltage. When the voltage of power source 7 is larger than the releasing voltage 9, the divided voltage will be larger than the breakdown voltage of diode ZD1. Because input end a1 has a voltage larger than that on input end b1, detecting circuit 14 will have a "HIGH" output voltage.

Detecting circuit 15 works in the similar way as detecting circuit 14. When the voltage of power source 7 is smaller than the engaging voltage 8, input end d1 will have a voltage equal to the breakdown voltage of the Zener diode ZD2 and input end c1 has a divided voltage, which follows power source 7, taken from the voltage divider formed by resistors R9 and R10. Since the voltage on the non-inverting input end c1 is smaller than that on the inverting input end d1 of IC2, detecting circuit 15 will have a "LOW" output. When the voltage of power source 7 is larger than the engaging voltage 8, input end c1 will have a voltage larger than the voltage (being a constant) of input end d1 so that detecting circuit 15 will have a "HIGH" input.

When the voltage of power source 7 is smaller than the engaging voltage 8, detecting circuits 14 and 15 will have same "LOW" outputs. So nonstandard AND gate circuit 16 is not actuated and thus coil 3 will not in any way be energized because the outputs of detecting circuits 14 and 15 are respectively connected to the base electrode of the transistor Q1 and the gate of the SCR1 of nonstandard AND gate circuit 16. When the voltage of power source 7 is larger than the engaging voltage 8, detecting circuits 14 and 15 will have same "HIGH" outputs, and the nonstandard AND gate circuit 16 will be conducted to actuate the buffer circuit 17 of the coil-holding circuit 17–22 to engage the electromagnetic switch. From the characteristic of SCR1, we know that after nonstandard AND gate circuit 16 is conducted, nonstandard AND gate circuit 16 will remain conducted even though the voltage of the power source falls below the engaging voltage 8 such that detecting circuits 14 and 15 respectively have a "HIGH" and a "LOW" outputs. Only when the voltage of the power source falls below the releasing voltage 9 so that both detecting circuits 14 and 15 have same "LOW" outputs, SCR1 is compulsively switched off, nonstandard AND gate circuit 16 is in an open state, and the electromagnetic switch is de-energized or released.

When nonstandard AND gate circuit 16 is open, the potential of the point g1 of buffer circuit 17, which includes a transistor Q2 and a diode D2, is "HIGH", so that transistor Q2 is not conducting and there is no output at point h1. When nonstandard AND gate circuit 16 is conducted, the potential at point g1 is "LOW", transistor Q2 is conducted, the potential at point h1 is "HIGH", and the engaging signal is fed into the monostable multi-vibrator 18 and a triangular wave generator 19. Through the point i1, multi-vibrator 18 sends its output to the base electrode n1 of the transistor Q3 of NOR gate circuit 21. The width of the output square wave of multi-vibrator 18 is determined by the time constant of the resistor R17 and the capacitor C5. Triangular wave generator 19, which includes an operational amplifier IC4, generates a triangular wave signal having a frequency determined by the resistor R20 and the capacitor C6, and send it through the point j1 to pulse generator 20. PUlse generator 20 includes an operational amplifier IC5. Selects the proper ratio of resistors R22 and R23, and the determined pulse width will then produced. Transistor Q3 and two diodes D4 and D5 constitute NOR gate circuit 21. The point n1 serves as an OR gate of the points i1 and k1 (the output end of IC5). The point m1 is the inverted output with respect to the point n1. Driver circuit 22 includes transistors Q4, Q5, Q6 and Q7.

When the switch is in a released state, multi-vibrator 18 and generator 20 have no output, so that the potentials at points i1 and k1 are "LOW" and the potential at point m1 is "HIGH". Transistors Q4 and Q6 are conducted, transistors Q5 and Q7 are "OFF", and coil 3 has no working voltage. When the voltage of the input power source is larger than the engaging voltage 8, both multi-vibrator 18 and generator 20 will have outputs. The potential of the point m1 is reduced to "LOW" so that transistors Q5 and Q7 will be "ON", transistors Q4 and Q6 will be "OFF" and coil 3 is energized through the circuit loop formed by transistor Q7, resistors R32 & R30 and bridge-rectifier circuit B1. After the time constant determined by R17 and C5 has passed, the potential at point i1 restores to "LOW" so that NOR gate circuit 21 receives only pulsating "ON-OFF" signals provided by generator 20. Driver circuit 22 intermittently provide a working voltage for coil 3 to maintain coil 3 in a holding state with a smaller current (in RMS).

Coil 3 will be kept in the holding state until the voltage of the power source falls below the releasing voltage 9 since detecting circuits 14 and 15 have a "LOW" output, nonstandard AND gate and buffer circuits 16 and 17 are "OFF", and, multi-vibrator 18 and generator 20 have no outputs. So driver circuit 22 provides no working voltage for coil 3. Thus coil 3 is de-energized.

Through the above description, it should now become readily apparent how and why the present invention can achieve the objects it contemplates. The above described embodiment, however, is only illustrative but not limitative and can easily be modified by those skilled in the art without departing from the spirit and scope of the present invention defined in the appended claims.

What I claim is:

1. A circuit device for an electromagnetic switch having a magnetic core and a coil to be energized by a power supply which is connected to an AC power source, comprising:

a releasing voltage detecting circuit connected to said power supply for detecting voltage of said power supply and determining whether said power supply voltage has reached a predetermined nonzero releasing voltage, said releasing voltage detecting circuit is adapted to send a "HIGH", i.e., "ON", output signal when said power supply is greater than or equal to said releasing voltage;

an engaging voltage detecting circuit connected to said power supply for detecting said power supply voltage and determining whether said power supply voltage has reached a predetermined engaging voltage, said engaging voltage being greater than said predetermined releasing voltage and said engaging voltage detecting circuit is adapted to send a "HIGH", i.e., "ON", output signal when said power supply is greater than or equal to said engaging voltage;

a gate circuit comprising a nonstandard AND gate connected to said releasing voltage detecting circuit and said engaging voltage detecting circuit, said gate circuit contains a standard AND means by which said gate circuit is designed to be turned "ON", i.e., becomes conducting, when both said releasing voltage detecting circuit and said engaging voltage detecting circuit send a "HIGH" signal thereto, said gate circuit also contains a nonstandard AND means by which said gate circuit maintains "ON" after it is initially turned "ON" until both said releasing voltage detecting circuit and said engaging voltage detecting circuit send a "LOW" signal, at which time said gate circuit will be turned "OFF"; and a coil-holding circuit, connected to said gate circuit and said coil, for energizing said coil when said gate circuit is turned "ON", and for de-energizing said coil when said gate circuit is turned "OFF".

2. A circuit device according to claim 1 wherein said coil-holding circuit is adapted to provide a first current to said coil for energizing said coil and a second current for keeping said coil in a holding state.

3. A circuit device according to claim 1, wherein said coil-holding circuit includes:

a buffer circuit connected to said gate circuit for receiving said "ON", i.e., engaging, and "OFF", i.e., releasing, signals therefrom;

a square wave generator, connected to said buffer circuit, having a circuit composed of at least one resistor and a capacitor, for producing at least one square wave signal whose time constant is determined by said resistor and said capacitor;

a triangular wave generator connected to said buffer circuit for generating triangular wave signals;

a pulse generator connected to said triangular wave generator for shaping said triangular wave signals into rectangular pulses;

a NOR gate circuit, coupled to said square wave generator and said pulse generator; and a driver circuit connected between said NOR gate and said coil for energizing said coil and de-energizing said coil.

4. A circuit device according to claim 1 wherein said nonstandard AND means comprises an SCR.

* * * * *